US007743745B2

(12) United States Patent
Scharp

(10) Patent No.: US 7,743,745 B2
(45) Date of Patent: Jun. 29, 2010

(54) MULTIPART, COOLED PISTON FOR A COMBUSTION ENGINE

(75) Inventor: Rainer Scharp, Vaihingen (DE)

(73) Assignee: Mahle International GmbH, Stuttgart (DE)

( * ) Notice: Subject to any disclaimer, the term of this patent is extended or adjusted under 35 U.S.C. 154(b) by 589 days.

(21) Appl. No.: 11/791,777

(22) PCT Filed: Nov. 28, 2005

(86) PCT No.: PCT/DE2005/002143

§ 371 (c)(1),
(2), (4) Date: Jul. 10, 2007

(87) PCT Pub. No.: WO2006/058524

PCT Pub. Date: Jun. 8, 2006

(65) Prior Publication Data

US 2008/0121204 A1 May 29, 2008

(30) Foreign Application Priority Data

Nov. 30, 2004 (DE) ..... 10 2004 057 624

(51) Int. Cl.
*F02F 3/18* (2006.01)

(52) U.S. Cl. ..... 123/193.6

(58) Field of Classification Search ..... 92/186, 92/256, 213, 216–219; 123/193.6
See application file for complete search history.

(56) References Cited

U.S. PATENT DOCUMENTS 5,081,968 A * 1/1992 Bruni ..... 123/193.6
5,261,363 A * 11/1993 Kemnitz ..... 123/193.6
5,778,533 A * 7/1998 Kemnitz ..... 29/888.049
6,659,062 B1 * 12/2003 Issler ..... 123/193.6
6,701,875 B2 * 3/2004 Weng et al. ..... 123/41.35
6,722,263 B2 * 4/2004 Keller et al. ..... 92/186
6,729,291 B1 5/2004 Scharp et al.
6,763,758 B2 7/2004 Kemnitz et al.
6,789,460 B2 * 9/2004 Kohnert ..... 92/186
6,938,604 B2 * 9/2005 Gabriel et al. ..... 123/193.6
7,131,418 B2 * 11/2006 Wieland ..... 123/193.6

FOREIGN PATENT DOCUMENTS

| | | |
|---|---|---|
| DE | 252 638 A1 | 12/1987 |
| DE | 3830033 | 6/1989 |
| DE | 4039751 | 6/1992 |
| DE | 4039754 | 6/1992 |
| DE | 4137126 | 5/1993 |
| DE | 10210570 | 9/2003 |
| DE | 10257022 | 6/2004 |
| GB | 2 205 922 A | 12/1988 |

OTHER PUBLICATIONS

International Search Report.

* cited by examiner

*Primary Examiner*—M. McMahon
(74) *Attorney, Agent, or Firm*—Collard & Roe, P.C.

(57) ABSTRACT

Disclosed is a multipart, cooled piston for a combustion engine, comprising, in a radially outward direction, an annular cooling duct located on the bottom side that faces away from the piston head. The cooling duct is closed by a cooling duct cover which is embodied as a ring. The cooling duct cover is provided with a tongue in the radially inner zone. The tongue engages into a recess that is molded into the bottom piston part, thus preventing the cooling duct cover from rotating relative to the piston during assembly as well as during operation.

2 Claims, 6 Drawing Sheets

MULTIPART, COOLED PISTON FOR A COMBUSTION ENGINE

CROSS REFERENCE TO RELATED APPLICATIONS

Figure 1:
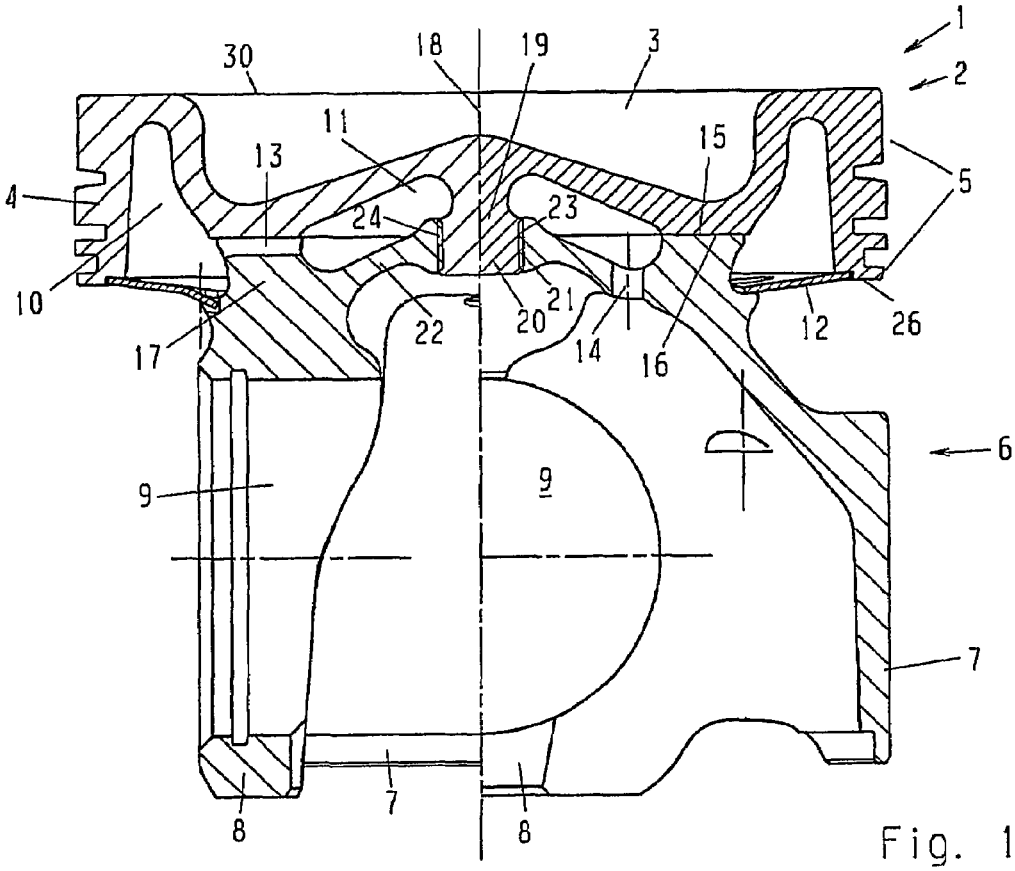

Applicant claims priority under 35 U.S.C. §119 of German Application No. 10 2004 057 624.6 filed Nov. 30, 2004. Applicant also claims priority under 35 U.S.C. §365 of PCT/DE2005/002143 filed Nov. 28, 2005. The international application under PCT article 21(2) was not published in English.

The invention relates to a multi-part cooled piston in accordance with the preamble of the claim.

A multi-part, cooled piston of the type stated above is known from the Offenlegungsschrift DE 102 57 022. In this connection, a cooling channel formed into the upper piston part is closed off by a lower piston part. It is a disadvantage in this connection that for this purpose, the lower piston part must have a special shape in the region of the cooling channel, and this results in a significant increase in expense of the production of the piston. Furthermore, pistons produced in this manner have a relatively great weight.

As a solution to this problem, it can be derived from the patent documents DD 252 638 and DE 41 37 126 to close off the cooling channel disposed in the upper piston part using a cover spring or a cover ring. However, in this connection the problem occurs that such cooling channel covers can perform independent rotational movements during engine operation. In order to avoid this, it is proposed in DD 252 638 to provide the ring-shaped cooling channel cover with a radially disposed gap, and to set it into a groove intended for this purpose, under bias, in that this gap is reduced using special pliers, when the cooling channel cover is set in place, and thereby the radius of the cooling channel cover is reduced. Nevertheless, there is a relatively great risk of rotation of the cooling channel cover because of the significant mass forces that occur at higher engine speeds of rotation.

The design configuration of the cover ring described in DE 41 37 126 offers better prevention of rotation; according to this, recesses are formed into the radially outer edge of the ring. The cover ring is attached in the piston in that its radially outer edge is introduced into a groove that is situated on the inside of a ring wall. Crosspieces are worked into this groove, which engage into the recesses after the ring has been set in, and thereby prevent rotation of the cover ring. However, this method of preventing rotation is very complicated, since first of all, a circumferential groove must be milled into the inside of the ring wall. Subsequently, the crosspieces must be worked into the groove at the points intended for this purpose.

It is the task of the invention to avoid these disadvantages of the state of the art. This task is accomplished with the characteristics standing in the characterizing part of the claim.

In this connection, the result is achieved, in simple and price-advantageous manner, that the cooling channel cover is built into the piston so that it absolutely cannot rotate, in that a tongue is punched into the radially linear region of a cooling channel cover in the form of a disk spring, and this tongue is slightly bent, so that it can engage into a recess formed into the outside of the piston.

An exemplary embodiment of the invention will be described below, using the drawings. These show FIG. 1 a piston in a two-part sectional diagram, the left half of which shows a section through the piston along a longitudinal axis of a pin bore, and the right half of which shows a section through the piston offset by 90° relative to the former, FIG. 2 an enlarged representation of a cooling channel of the piston, closed off by a cooling channel cover in the manner of a disk spring, FIG. 3 a part of the cooling channel cover, which shows a tongue formed by two punched areas that lie next to one another, FIG. 4 a section through the cooling channel cover in the region of the tongue, along the line CC in FIG. 3, FIG. 5 a partial section along the line AA in FIG. 2, in the region of the pin boss support, into which a recess for accommodating the tongue of the cooling channel cover is formed, and FIG. 6 a partial section along the line BB in FIG. 2, which shows part of the cooling channel cover that lies on the projection of the pin boss support, the tongue of which cover engages into the recess of the pin boss support.

FIG. 1 shows a multi-part, cooled piston 1 that consists of an upper piston part 2 having a combustion bowl 3 in the piston crown 30 and having a ring wall 4 with ring belt 5 in the radially outer piston region, and of a lower piston part 6 that comprises a box-shaped piston skirt 7 and two pin bosses 8 connected with the latter, each having a pin bore 9 for accommodating a piston pin not shown in the figure. The upper piston part 2 has an outer, ring-shaped cooling channel 10, and an inner cooling channel 11, disposed concentric to the former, whereby the outer cooling channel 10 is closed off by a cooling channel cover 12, in the manner of a disk spring, formed slightly conically, and configured as a one-part, closed ring, which cover has openings for passing cooling oil in and out, not shown in the figures. The outer cooling channel 10 is connected with the inner cooling channel 11 by way of at least one overflow channel 13 is. This overflow channel 13 can be configured as a bore. The inner cooling channel 11 has at least one run-off bore 14, by way of which the cooling oil can run out of the inner cooling channel 11.

In this connection, the upper piston part 2 is mounted on an upper contact surface 16 of a ring-shaped pin boss support 17 of the lower piston part 6 by way of a ring-shaped contact surface 15 that is disposed on the underside of the upper piston part 2, facing away from the combustion bowl 3.

On the underside facing away from the combustion bowl 3, the upper piston part 2 has a pin 19 disposed in the center and coaxial to the piston axis 18, the end 20 of which is provided with a thread 21. A region 22 of the lower piston part 6 that borders radially on the inside on the pin boss support 17, which region delimits the inner cooling channel 11, together with the upper piston part 2, is configured with a relatively thin wall and is provided, in its center, with a bore 23 disposed coaxial to the piston axis 18, which bore has an inside thread 24 that fits into the thread 21 of the pin 19. The piston 1, which consists of the upper part and lower part 2, 6, is held together by means of the screw connection 19 formed by the threaded bore 23 and the threaded pin 19.

The upper piston part 2 consists of steel and can either be forged or produced using the extrusion method. The lower piston part 6 is preferably forged from steel.

Figure 2:
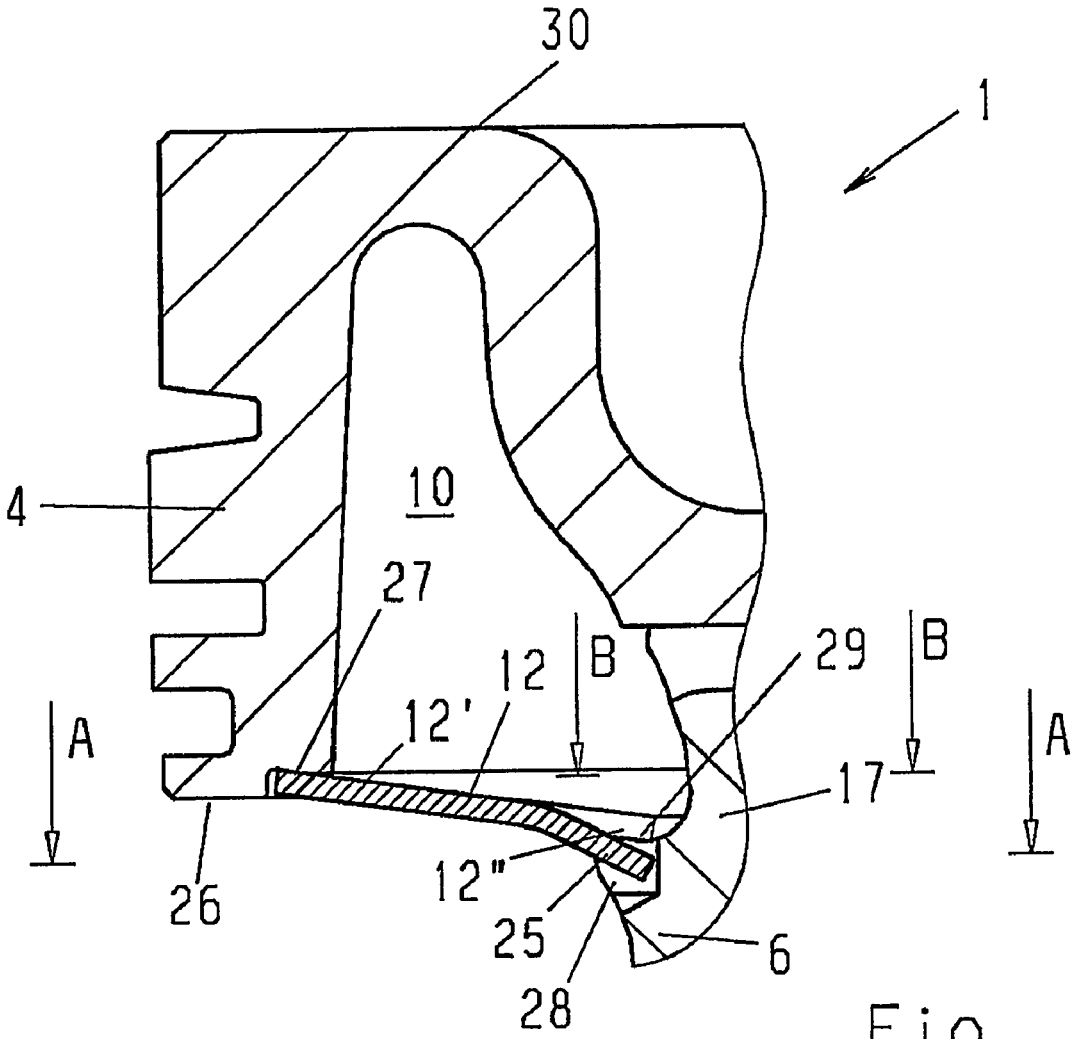

In FIG. 2, the cooling channel 10, closed off by the cooling channel cover 12 in the manner of a disk spring, is shown enlarged, so that it is evident that the radially outer region 12' of the cooling channel cover 12 is mounted in a step-shaped recess 27 that lies radially inside, formed into the face 26 of the ring wall 4 that faces the pin boss, and that the radially inner region 12" of the cooling channel cover 12 lies on a projection 29 that is formed onto the pin boss support 17. Furthermore, it is evident that the inner region 12" of the cooling channel cover 12 has a tongue 25 bent in the pin boss direction, which engages into a recess 28 worked radially on the outside into the projection 29, in order to thereby achieve securing of the cooling channel cover 12 to prevent rotation during assembly and during engine operation.

Figure 3:
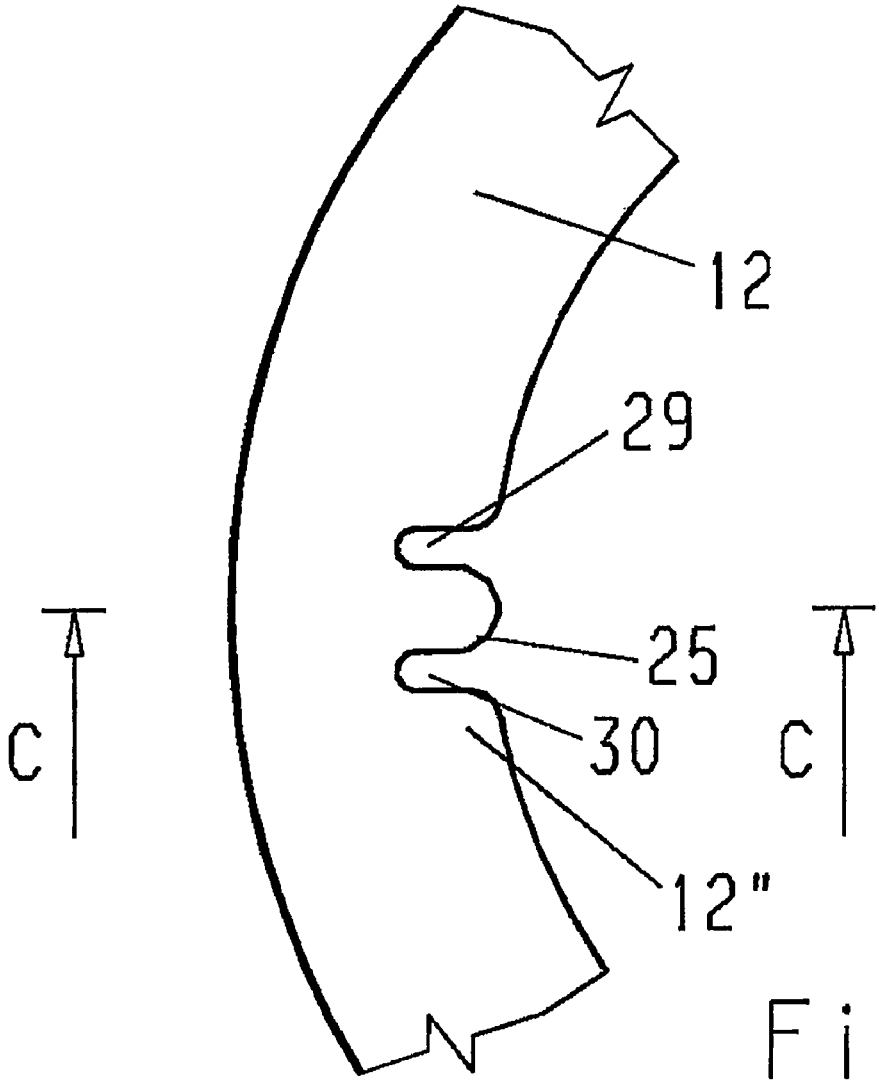
Figure 4:
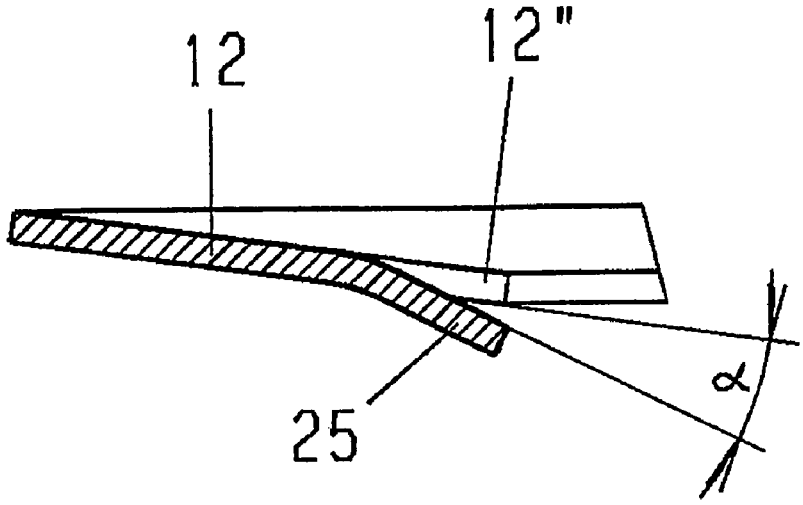

FIGS. 3 to 6 serve to better illustrate these latter characteristics. FIG. 3 shows, in a top view, part of the cooling channel cover 12, in the inner region 12" of which the tongue 25 is formed by two punched areas 29 and 30 that lie next to one another, which tongue, as shown in FIG. 4, a sectional diagram of the cooling channel cover 12 along the line CC in FIG. 3, is bent away from the imaginary plane formed by the cooling channel cover 12, and encloses an acute angle □ with the inner region 12" of the cooling channel cover 12.

Figure 5:
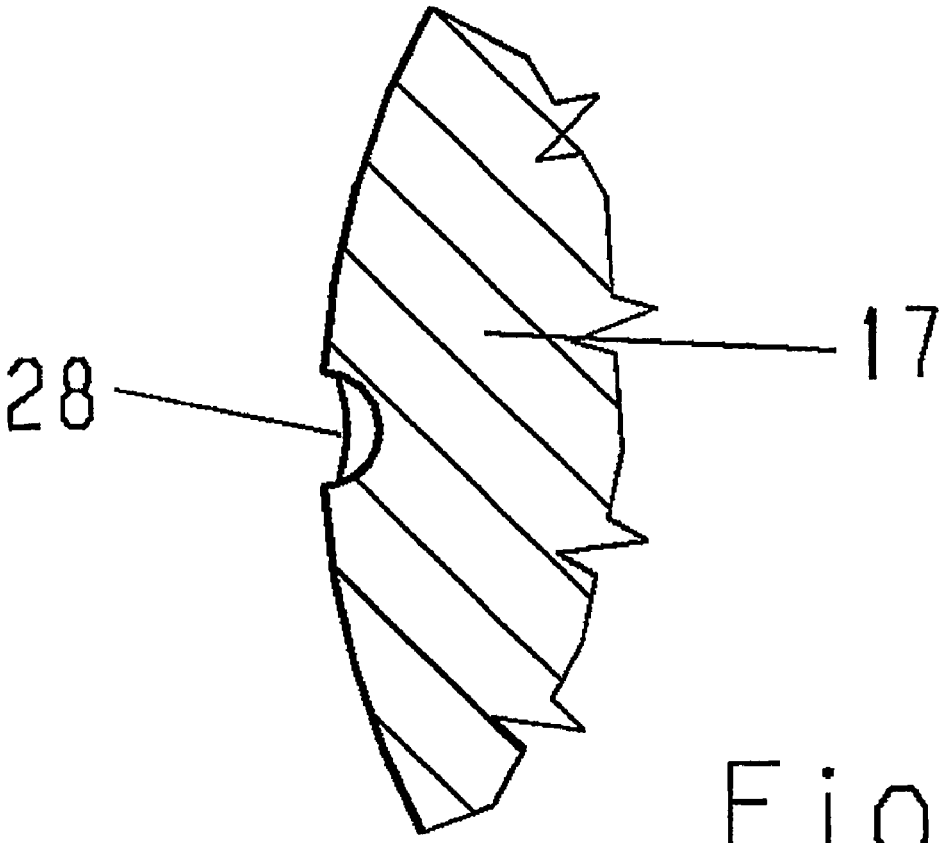

FIG. 5, a partial section through the pin boss support 17 (without showing the cooling channel cover 12) along the line AA in FIG. 2, shows the shape and the arrangement of the recess 28 that is formed into the radial outside of the pin boss support 17 for accommodating the tongue 25.

Figure 6:
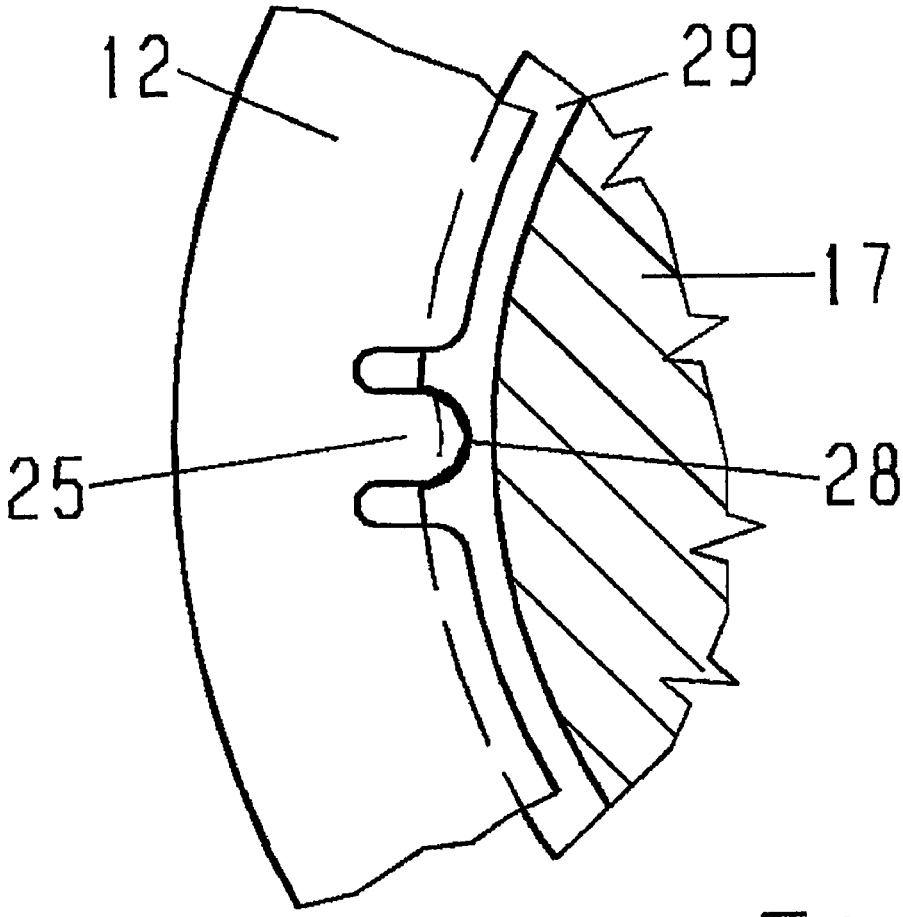

In FIG. 6, a section along the line BB in FIG. 2, it can be seen how the cooling channel cover 12 lies on the projection 29 formed onto the pin boss support 17, whereby the tongue 25 engages into the recess 28, in order to guarantee that the cooling channel cover 12 is prevented from rotating; this is particularly important during assembly of the piston 1.

In this connection, the cooling channel cover 12 in the form of a disk spring is first laid onto the lower piston part in such a manner that the tongue 25 engages into the recess 28, as shown in FIG. 6. Subsequently, the upper piston part 2 is screwed onto the lower piston part 6, whereby the threaded pin 19 of the upper piston part 2 is screwed into the threaded bore 23 of the region 22. In this connection, the elasticity of the relatively thin-walled region 22 has the result that the latter deforms like a disk spring when the upper piston part and lower piston part 2, 6 are screwed together, and that the inner center of the region 22, provided with the threaded bore 23, domes up in the direction of the upper piston part 2. As a result, a bias is exerted on the screw connection between upper piston part and lower piston part 2, 6 by the region 22, which bias increases the strength of the screw connection between upper piston part and lower piston part 2, 6, so that an additional counter-nut for achieving a permanent assembly connection is not necessary. In this connection, the relative position of the cooling channel cover 12 with regard to the lower piston part 6 is maintained because of the inhibition of rotation that is brought about by the tongue 25 engaging into the recess 28.

The conical shape of the cooling channel cover 12 is more marked in the relaxed state than in the installed state. When the upper piston part and lower piston part 2, 6 are screwed together, the conicity of the cooling channel cover 12 is reduced, i.e. the shape of the cooling channel cover 12 becomes flatter, and a bias is produced in the cooling channel cover 12, which guarantees, after final assembly of the piston 1, that the cooling channel cover 12 lies firmly partly in the recess 27 of the face surface 26 and partly on the projection 29, and that secure and firm assembly of the cooling channel cover 12 in the piston 1 is guaranteed even during fast back and forth movements of the piston 1, which are usual in engine operation.

REFERENCE SYMBOL LIST

1 piston
2 upper piston part
3 combustion bowl
4 ring wall
5 ring belt
6 lower piston part
7 piston skirt, skirt element
8 pin boss
9 pin bore
10 outer cooling channel
11 inner cooling channel
12 cooling channel cover, ring
12' outer region of the cooling channel cover 12
12" inner region of the cooling channel cover 12
13 overflow channel
14 run-off bore
15 contact surface
16 contact surface
17 pin boss support
18 piston axis
19 pin, threaded pin
20 end of the pin 19
21 thread
22 region
23 bore, threaded bore
24 inside thread
25 tongue
26 face surface of the ring wall 4
27 recess
28 recess
29 projection
30 piston crown

The invention claimed is:

1. Multi-part, cooled piston (1) for an internal combustion engine, having an upper piston part (2)

that forms the piston crown (30), that has a ring-shaped cooling channel (10) radially on the outside, on the underside that faces away from the piston crown (30), that has a ring wall (4) that delimits the cooling channel (10) radially towards the outside, having a ring part (5) on the radial outside of the wall, and on the underside of which, a pin (19) situated centrally and coaxial to the piston axis (18), having a thread (21), is disposed, having a cooling channel cover (12) for closing off the cooling channel (10), configured as a ring in the manner of a disk spring, and having a lower piston part (6)

that has two pin bosses (8) and skirt elements (7) that connected the pin bosses (8) with one another, that has a region (22) connecting the skirt elements (7) and the pin bosses (8) with one another on the piston crown side, into which region a bore 23 situated centrally and coaxial to the piston axis (18), having an inside thread (24) that fits into the thread (21) of the pin (19), is formed, so that after the cooling channel cover (12) is laid onto a projection (29) formed onto the lower piston part (6) close to the cooling channel (10), the upper piston part (2) and the lower piston part (6) can be screwed together with one another by way of the threaded pin (19) and the threaded bore (23), whereby the radially outer region (12') of the cooling channel cover (12) lies on the face surface (26) of the ring wall (4) that faces away from the piston crown, and the radially inner region (12") of the cooling channel cover (12) lies on the projection (29), under bias, wherein two punched areas (29, 30) directed radially inward are introduced into the radially inner region (12") of the cooling channel cover (12), at such a distance from one another that a tongue (25) directed radially inward results between them, the tongue (25) encloses an acute angle with the inner region (12") of the cooling channel cover (12), the projection (29) has a recess (28) radially on the outside, into which the tongue (25) of the cooling channel cover (12) engages when upper piston part (2) and lower piston part (6) are screwed together.

2. Multi-part, cooled piston (1) according to claim 1, wherein the cooling channel cover (12) configured as a one-part and closed ring.

* * * * *